US007096693B2

(12) United States Patent
Yui

(10) Patent No.: US 7,096,693 B2
(45) Date of Patent: Aug. 29, 2006

(54) KNITTING METHOD FOR KNITTING FABRIC

(75) Inventor: Manabu Yui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/544,904

(22) PCT Filed: Mar. 2, 2004

(86) PCT No.: PCT/JP2004/002579

§ 371 (c)(1),
(2), (4) Date: Aug. 10, 2005

(87) PCT Pub. No.: WO2004/079070

PCT Pub. Date: Sep. 16, 2004

(65) Prior Publication Data

US 2006/0137405 A1 Jun. 29, 2006

(30) Foreign Application Priority Data

Mar. 7, 2003 (JP) ..... 2003-062432

(51) Int. Cl.
*D04B 7/10* (2006.01)

(52) U.S. Cl. ..... 66/64

(58) Field of Classification Search ..... 66/64, 66/69, 171, 175, 176
See application file for complete search history.

(56) References Cited

U.S. PATENT DOCUMENTS 5,263,342 A * 11/1993 Mundstock ..... 66/198
5,417,088 A * 5/1995 Nakai ..... 66/76
6,651,462 B1 * 11/2003 Okamoto ..... 66/64
6,658,899 B1 * 12/2003 Okamoto ..... 66/64
6,766,666 B1 * 7/2004 Okamoto ..... 66/64
6,857,294 B1 * 2/2005 Okamoto ..... 66/64

FOREIGN PATENT DOCUMENTS

JP 3-75656 12/1991
JP 2958697 7/1999

* cited by examiner

*Primary Examiner*—Danny Worrell
(74) *Attorney, Agent, or Firm*—Rothwell, Figg, Ernst & Manbeck, P.C.

(57) ABSTRACT

A knitting method for knitting a knitted fabric having a half cardigan knitting structure of well-balanced loops without getting out of loop shape. The half cardigan knitting structure comprises first wale in which knitted loops and tuck loops are formed and second wale in which only the knitted loops are formed are formed alternately with alternate needles. The knitted loops of the first wale are supplied to a front needle bed (FB), and the knitted loops of the second wale are supplied to a back needle bed (BB). The knitted loops of the first wale are transferred to confronting empty needles of the back needle bed (BB). Then, the loops of the second wale are formed on the back needle bed (BB), while the tuck loops are formed on the needles of the front needle bed (FB) which confront the needles of the back needle bed (BB) hooking the knitted loops of the first wale and also the knitting yarn is temporarily held on adjoining needles to that needle. Then, the temporarily-held knitting yarn is released. Then, the knitted loops of the first wale hooked by the back needle bed (BB) are transferred to the needles of the front needle bed (FB) hooking the tuck loops thereon.

5 Claims, 7 Drawing Sheets

KNITTING METHOD FOR KNITTING FABRIC

CROSS REFERENCE TO RELATED APPLICATIONS

This application is a 35 USC § 371 National Phase Entry Application from PCT/JP2004/002579, filed Mar. 2, 2004, and designating the United States.

TECHNICAL FIELD

The present invention provides a method for knitting a knitted fabric of a half cardigan knitting structure of a coarse knitting gauge.

BACKGROUND ART

A knitted fabric having a half cardigan loop structure is illustrated in FIG. 5 in an understandable way. FIG. 5 shows a front side of the half cardigan knitting structure wherein first wale "a" formed by back stitches of tuck loops and knitted loops and second wale "b" formed by front stitches of knitted loops are alternately formed.

In FIG. 5, a knitted loop of the first wale "a" has a height corresponding to two courses of knitted loops of the second wale "b". In the first wale "a", the knitted loops and the tuck loops are in the state of being overlapped with each other.

A coarse-knitting-gauge knitted fabric having the half cardigan knitting structure can be knitted by the knitting method for providing roughened loops using alternate needles of needle beds of a knitting machine. Take a 5-gauge knitting machine designed for providing five-gauge texture for the knitted fabric, for instance, it can also provide a coarse-textured knitted fabric by knitting with alternate needles. The method for providing a coarse knitting gauge for the knitted fabric using alternate needles is described, for example, by JP Laid-open (Unexamined) Patent Publication No. Hei 11-189954.

When this half gauge knitting is used to provide the coarse loops for the knitted fabric, a thicker yarn can be used for the same knitting machine, and as such can provide texture differences for the knitted fabric of the same half cardigan structure.

There is proposed a knitting technique to allow the loops formed during the course knitting to be roughened by using empty needles located between adjoining loops and not involved in knitting during the formation of the loops. In this knitting technique, during the course knitting, knitted loops are formed with and the knitting yarn is temporarily held on the empty needles and, thereafter, the temporarily held loops are knocked over from the empty needles. This knitting technique is commonly called "drop knitting". When this drop knitting is used in combination with the half gauge knitting using alternate needles, the loops knitted can be roughened further.

FIGS. 6 and 7 illustrate a knitting method for knitting the half cardigan knitting structure by combination of the half gauge knitting using alternate needles and the drop knitting. The front side of the knitted fabric produced by this knitting method takes the form of the back side of the knitted fabric of FIG. 5.

FIGS. 6 and 7 show the knitting process drawings showing the knitting steps of knitting a knitted fabric into tubular form by using a flat knitting machine having a front needle bed FB and a back needle bed BB. In this knitting process, a front knitted fabric part having a half cardigan structure is knitted on the front needle bed FB and back knitted fabric part of the half cardigan structure is knitted on the back needle bed BB.

FIG. 6(1) shows the state that knitted loops of the front knitted fabric part are hooked by knitting needles of the front needle bed FB, and knitted loops of the back knitted fabric part are hooked by knitting needles of the back needle bed BB. The front knitted fabric part is knitted by one course from this state, first. Of the loops hooked by the knitting needles of the front needle bed FB, the knitted loops to form the second wale of FIG. 5 are transferred to empty needles of the back needle bed BB, as shown in FIG. 6(2). At this time, the knitted loops to form the first wale of FIG. 5 are left on the front needle bed FB.

Then, at the same time that tuck loops of the first wale are formed with knitting needles B of the front needle bed FB, the knitting yarn is temporarily held on the empty needles A located at both lateral sides of the needles B and, then, knitted loops of the second wale are formed with needles C by which the knitted loops transferred to the back needle bed BB are hooked (FIG. 6(3)). Then, after the knitting yarn temporarily held on the empty needles A at the both lateral sides of the needles B is released in the state of FIG. 6(3) (FIG. 6(4)), the knitted loops hooked by the needles C of the back needle bed BB are transferred back to the needles of the front needle bed FB to produce the state of FIG. 6(5).

Then, the back knitted fabric part is knitted one course. Of the knitted loops hooked by the knitting needles of the back needle bed BB, the knitted loops to form the second wale of FIG. 5 are transferred to empty needles of the front needle bed FB, as shown in FIG. 6(6). At this time, the knitted loops to form the first wale of FIG. 5 are left on the back needle bed BB.

Then, at the same time that tuck loops of the first wale are formed with knitting needles E of the back needle bed BB, the knitting yarn is temporarily held on empty needles C, D located at both lateral sides of the needles E and, then, knitted loops of the second wale are formed with needles A in which the knitted loops transferred to the front needle bed FB are hooked (FIG. 6(7)). After the knitted loops held by the empty needles C, D at the both lateral sides of the needles E are released in the state of FIG. 6(7) (FIG. 6(8)), the knitted loops hooked by the needles A of the front needle bed FB are transferred back to the needles of the back needle bed BB to produce the state of FIG. 6(9).

Then, the knitting of the front knitted fabric part proceeds. As shown in FIG. 7(10), after the knitted loops of the second wale on the front needle bed FB are transferred to empty needles C of the back needle bed BB, the knitted loops are formed with these needles C. In parallel with this, the knitted loops of the first wale of the front knitted fabric part are formed with the needles B and also the knitting yarn is temporarily held on the empty needles A at both lateral sides of the needles B.

Then, as shown in FIG. 7(11), after the knitted loops held on the empty needles A are released therefrom, the knitted loops hooked in the needles C of the back needle bed BB are transferred to the knitting needles of the front needle bed FB to produce the state of FIG. 7(12).

Then, the knitting of the back knitted fabric part proceeds. As shown in FIG. 7(13), after the knitted loops of the second wale on the back needle bed BB are transferred to empty needles A of the front needle bed FB, the knitted loops are formed with these needles A. In parallel with this, the knitted loops of the first wale of the back knitted fabric part are knitted with the needles E and also the knitting yarn is temporarily held on the empty needles C, D at both lateral sides of the needles E.

Then, as shown in FIG. 7(14), after the knitting yarn temporarily held on the empty needles C, D are released therefrom, the knitted loops hooked in the needles A of the front needle bed FB are transferred to the knitting needles of the back needle bed BB to produce the state of FIG. 7(15).

By repetition of the knitting steps illustrated in FIG. 6(1) through FIG. 7(15), the half cardigan knitting structure shown in FIG. 5 can be knitted with roughened loops. In this half cardigan knitting structure, the knitting yarn temporarily held on the empty needles shown in FIG. 6(3)(7) and FIG. 7(10)(13) serve as a drop portion or a length adjusting portion for the knitted loops and the tuck loops to be increased in size. The knitting yarn temporarily held on the empty needles can allow the tuck loops and the knitted loops knitted to increase in loop length.

Incidentally, in the conventional knitting method for knitting the half cardigan knitting structure illustrated in FIGS. 6 and 7, when the tuck loops are formed, the tuck loops are put in the state of being overlapped with the knitted loops of the first wale formed with and held on the needles B in the previous knitting step. In addition, the temporarily-held knitting yarn is continuous with the tuck loops of the first wale and the knitted loops of the second wale.

Due to this, when the knitting yarn temporarily held when the tuck loops are formed is released, the knitting yarn continuous with the tuck loops which are in contact with the knitted loops does not slip smoothly, due to which it becomes hard for the knitting yarn dropped to be absorbed in the loops around.

This can provide an undesirable result that sinker loops between the first wale and the second wale are elongated partly, so that the respective loops are badly balanced to prevent symmetric formation of the knitted fabric. This can also provide the disadvantage of making it hard to do the loop transference and the knitting.

Particularly when the knitting yarn is temporarily held on only a single needle, or when the knitting yarn is temporarily held on only the empty needle at one lateral side of the needle used to form the tuck loop and is not held on the empty needle at the other lateral side thereof, the knitted fabric becomes badly balanced further.

In the light of the disadvantages mentioned above, the present invention has been developed. It is an object of the present invention to provide a knitting method for knitting a knitted fabric according to which even when a knitted fabric of a half cardigan knitting structure is knitted by the half gauge knitting combined with the knitting technique of temporarily holding the knitting yarn on the needles, the loops of the knitted fabric can be prevented from getting out of shape to provide a knitted fabric of well-balanced loops.

DISCLOSURE OF THE INVENTION

The present invention provides a knitting method for knitting a knitted fabric having a half cardigan knitting structure wherein first wale in which knitted loops and tuck loops are formed and second wale in which only the knitted loops are formed are alternately formed with alternate needles of a flat knitting machine comprising at least a pair of front and back needle beds which are arranged to extend laterally and opposite to each other in a cross direction and between which loops of the knitted fabric are transferred, the method comprising:

1) the first step of supplying the knitted loops of the first wale to one of the needle beds and supplying the knitted loops of the second wale to the other needle bed and then transferring the knitted loops of the first wale to confronting empty needles of the other needle bed, 2) the second step of forming the knitted loops of the second wale on the other needle bed, while forming the tuck loops on the needles of the one needle bed which confront the needles of the other needle bed hooking the knitted loops of the first wale and also holding the knitting yarn temporarily on at least one of adjoining needles to the needle forming the tuck loop thereon, 3) the third step of releasing the knitting yarn temporarily held on the needles therefrom, 4) the fourth step of transferring the knitted loops of the first wale hooked by the needles of the other needle bed to the needles of the one needle bed hooking the tuck loops, 5) the fifth step of forming the loops, following the tuck loops and knitted loops of the first wale hooked by the needles of the one needle bed, and also holding the knitting yarn temporarily on at least one of the adjoining needles to the needle used to form the first wale and then forming the loops of the second wale on the needles of the other needle bed, and 6) the sixth step of releasing the knitting yarn temporarily held on the needles therefrom.

Further, after completion of the sixth step, the steps 1–6 may be repeated to knit the half cardigan knitting structure formed by a number of courses.

The knitting method comprising the steps 1–6 mentioned above is a basic knitting method for knitting the half cardigan knitting structure. By using this knitting method, a planar knitted fabric and a tubular knitted fabric can be knitted. When the tubular knitted fabric is knitted in a continuous manner, it is preferably knitted by the following method.

The knitting method comprises the following steps for knitting a tubular knitted fabric having a front knitted fabric part and a back knitted fabric part and having the half cardigan knitting structure in at least one of the front knitted fabric part and the back knitted fabric part: the first step wherein the knitted loops of the first wale and the second wale of at least either the front knitted fabric part or the back knitted fabric part, at least either of which has the half cardigan knitting structure, are all transferred to empty needles of the opposite needle bed, and the fifth step wherein the knitted loops of the second wale of at least either the front knitted fabric part or the back knitted fabric part, at least either of which has the half cardigan knitting structure, are all transferred to the empty needles of the opposite needle bed and knitted with those needles of the opposite needle bed, and, then, the loops are formed, following the tuck loops and the knitted loops of the first wale and also the knitting yarn is temporarily held on at least one of adjoining needles to the needle used to form the first wale.

To be specific, it is preferable that the knitting method comprises the following steps:

1) the first step of transferring all the knitted loops of the first wale and the second wale to confronting empty needles of the other needle bed in the state in which the knitted loops of the first wale and the knitted loops of the second wale of the front knitted fabric part are supplied to the one needle bed and the knitted loops of the first wale and the knitted loops of the second wale of the back knitted fabric part are supplied to the other needle bed, 2) the second step for the front knitted fabric part of forming the knitted loops of the second wale on the other needle bed, while also forming the tuck loops on the needles of the one needle bed which confront the needles of the other needle bed hooking the knitted loops of the first wale and also holding the knitting yarn temporarily on at least one of adjoining needles to the needle forming the tuck loop thereon, 3) the third step for the front knitted fabric part of releasing the knitting yarn temporarily held on the needles of the one needle bed therefrom, 4) the fourth step for the front knitted fabric part of transferring the knitted loops of the first wale hooked by the needles of the other needle bed to the needles of the one needle bed hooking the tuck loops, and transferring the knitted loops of the second wale to confronting needles of the one needle bed, 5) the fifth step for the back knitted fabric part of transferring all the knitted loops of the first wale and the second wale to confronting empty needles of the one needle bed, 6) the sixth step for the back knitted fabric part of forming the loops of the second wale on the one needle bed and forming the tuck loops on the needles of the other needle bed confronting the needles of the one needle bed hooking the knitted loops of the first wale, while also holding the knitting yarn temporarily on at least one of the adjoining needles to the needle used to form the tuck loops, 7) the seventh step for the back knitted fabric part of releasing the knitting yarn temporarily held on the needles of the other needle bed therefrom, 8) the eighth step for the back knitted fabric part of transferring the knitted loops of the first wale hooked by the needles of the one needle bed to the needles of the other needle bed hooking the tuck loops and transferring the knitted loops of the second wale to the confronting needles of the other needle bed, 9) the ninth step for the front knitted fabric part of transferring the knitted loops of the second wale to the confronting empty needles of the other needle bed and then knitting those loops of the second wale with the needles of the other needle bed, while also forming the loops following the tuck loops and knitted loops of the first wale hooked by the needles of the one needle bed and holding the knitting yarn temporarily on at least one of the adjoining needles to the needle used to form the first wale, 10) the tenth step for the front knitted fabric part of releasing the knitting yarn temporarily held on the needles of the one needle bed therefrom, 11) the eleventh step for the front knitted fabric part of transferring the knitted loops of the second wale to the confronting needles of the one needle bed, 12) the twelfth step for the back knitted fabric part of transferring the knitted loops of the second wale to the confronting empty needles of the one needle bed and then knitting those loops of the second wale with the needles of the one needle bed, while also forming the loops following the tuck loops and knitted loops of the first wale hooked by the needles of the other needle bed and holding the knitting yarn temporarily on at least one of the adjoining needles to the needle used to form the first wale, 13) the thirteenth step for the back knitted fabric part of releasing the knitting yarn temporarily held on the needles of the other needle bed therefrom, and 14) the fourteenth step for the back knitted fabric part of transferring the knitted loops of the second wale to the confronting needles of the other needle bed.

In the knitting method for knitting the tubular knitted fabric, after completion of the fourteenth step, the steps 1–14 are repeated so that the tubular knitted fabric having the half cardigan knitting structure knitted with a number of courses in the front and back knitted fabric parts can be knitted.

As described above, the present invention is characterized by the drop knitting wherein after the knitted loops of the first wale hooked by the needles of the one needle bed are all transferred to the other needle bed, the tuck loops are formed by and the knitting yarn is temporarily held on the empty needles of the one needle bed and then the temporarily-held kitting yarn is released. In the present invention, the knitting technique to allow the loops formed during the course knitting to be roughened is called the drop knitting, wherein during the course knitting, the loops are formed with and the knitting yarn is temporarily held on the empty needles located between adjoining loops and not involved in the knitting during the formation of the loops and, thereafter, the temporarily-held knitting yarn is knocked over from the empty needles.

The passage "at least one of the adjoining needles to the needle used to form the tuck loop on which the knitting yarn is temporarily held" is intended to include, for example, the adjoining needles on the same needle bed.

Since the present invention can allow the tuck loops of the first wale and the temporarily-held knitting yarn to be formed without overlapping with the knitted loops (old loops) of the first wale, even when the temporarily-held knitting yarn is released from the needles after the formation of the knitted loops of the second wale, the tuck loops and the temporarily-held knitting yarn are prevented from contacting with the old loops knitted before the formation of the tuck loops.

This means that when the temporarily-held knitting yarn is released, the needles hooking the tuck loops thereon are already changed to the empty needles. This can allow the knitting yarn to slip smoothly in the needle hook, and as such can allow smooth drop of the knitted fabric. This can provide the result that although the tuck loops are supported on the needle, the temporarily-held knitting yarn, when released from the needle, is absorbed in the tuck loops and in the knitted loops of the second wale in a well-balanced manner. As a result of this, lengths of the knitting yarn extending from both legs of the tuck loop hooked on the needle to the needles in which the knitted loops of the second wale are hooked are well balanced.

Then, the knitted loops of the first wale are transferred back to the needles of the one needle bed hooking the tuck loops thereon from the other needle bed in the state in which the lengths of the knitting yarn extending from both legs of the tuck loop are well balanced, so that the first wale is put in the state of the tuck loops and the knitted loops being overlapped with each other.

This formation of the tuck loops in the first wale can always allow the tuck loops to have well-balanced and elongated loop lengths and can also provide well-balanced knitted loops round.

The knitting yarn may be temporarily held on both or either the needle on the right side of the needle used to form the tuck loop or the needle on the left side thereof in accordance with the lengths of the temporarily-held knitting yarn dropped (the size of the knitted loop and the tuck loop). The loop lengths of the loops can be adjusted by adjusting the lengths of the temporarily-held knitting yarn dropped.

BEST MODE FOR CARRYING OUT THE INVENTION

Figure 1:
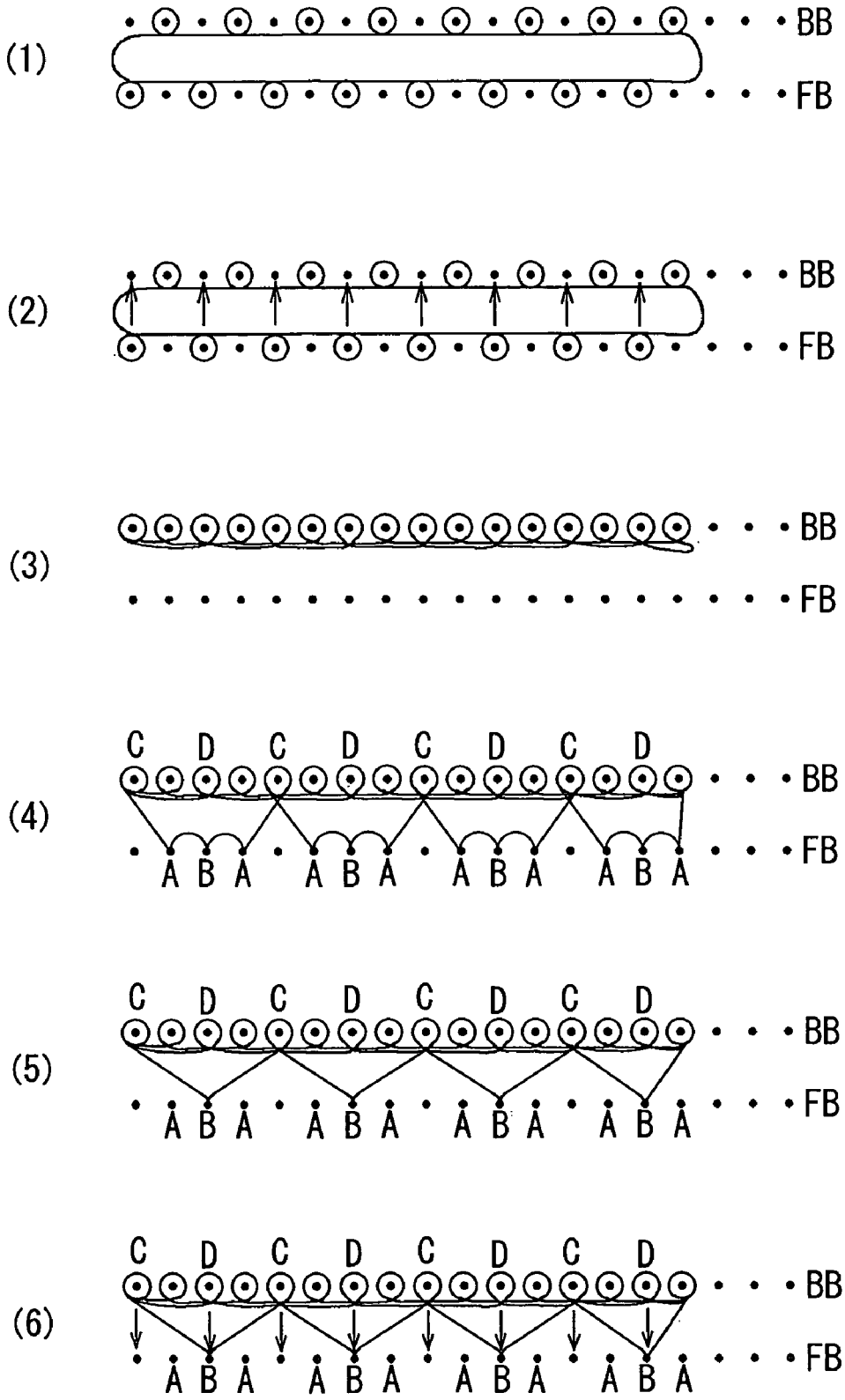
FIG. 1 is a knitting process drawing of a knitting method for knitting a knitted fabric having a half cardigan knitting structure according to the present invention.

In the following, a preferred embodiment of a knitting fabric knitting method according to the present invention will be described with reference to the accompanying drawings.

In this embodiment, a tubular knitted fabric of a seamless knit is knitted using a so-called two-bed flat knitting machine having a pair of front and back needle beds extending laterally and confronting each other in back and front and being constructed so that the back needle bed can be racked laterally to allow loop transference between the front and back needle beds.

When the tubular knitted fabric is knitted using this two-bed flat knitting machine, alternate needles on each of the front and back needle beds are used for the knitting. For example, when the knitwear is knitted, odd needles on the front needle bed are used mainly for a front knitted fabric part and even needles on the back needle bed are used mainly for a back knitted fabric part.

Further, the needles on one of the front and back needle beds are used as the knitting needles, and the needles on the other needle bed opposed to the needles on the one needle bed are used as empty needles. By using the empty needles for the loop transference, the rib knitting, and the like, a structure pattern, such as, for example, a half cardigan knitting structure, can be knitted.

The two-bed flat knitting machine may be modified to dispose a transfer jack bed, on which transfer jacks are arranged in line, over either or both of the front and back needle beds, so that the knitted fabric is knitted with the needles combined with the transfer jacks.

Although the two-bed flat knitting machine is used to knit the knitted fabric in the illustrated embodiment, a four-bed flat knitting machine comprising an upper front needle bed, a lower front needle bed, an upper back needle bed, and a lower back needle bed may be used as an alternative to the two-bed flat knitting machine, to knit the knitted fabric.

When the four-bed flat knitting machine is used, for example the front knitted fabric part is supplied to the lower front needle bed and the back knitted fabric part is supplied to the lower back needle bed. Then, the needles of the upper back needle bed are used as empty needles to which loops of the front knitted fabric part are transferred when the front knitted fabric part is knitted and the needles of the upper front needle bed are used as empty needles to which loops of the back knitted fabric part are transferred when the back knitted fabric part is knitted.

In the illustrated embodiment, a tubular knitted fabric having a half cardigan knitting structure of a coarse knitting gauge in the front and back knitted fabric parts is knitted seamlessly using the two-bed flat knitting machine.

An embodiment of the present invention will be described with reference to FIGS. 1 to 4. FIGS. 1–4 show knitting process drawings of a knitting method of the present invention. The knitting process drawings illustrate the processes of knitting the knitted fabric in a tubular form using the flat knitting machine having the front needle bed FB and the back needle bed BB. Knitted in this embodiment is the knitted fabric having the half cardigan knitting structure wherein the first wale in which the knitted loops and the tuck loops are formed with alternate needles and the second wale in which only the knitted loops are formed are formed alternately. It is to be noted that the front side of the knitted fabric knitted in the illustrated embodiment takes the form of the back side of the half cardigan knitting structure of FIG. 5.

Now, a knitted fabric knitting method according to the present invention will be described with reference to the illustrated embodiment. First, knitted loops of front knitted fabric part are hooked by the knitting needles of the front needle bed FB and knitted loops of back knitted fabric part are hooked by the knitting needles of the back needle bed BB, as shown in FIG. 1(1). Then, the knitted loops hooked by the knitting needles of the front needle bed FB are all transferred to empty needles of the back needle bed BB, as shown in FIG. 1(2), to produce the state of FIG. 1(3) (1st step).

Then, among the knitted loops transferred to the empty needles of the back needle bed BB, the knitted loops following the knitted loops of the second wale (the knitted loops hooked by the needles C) are knitted on the back needle bed BB, as shown in FIG. 1(4). In parallel with this, tuck loops are formed on the needles B of the front needle bed FB confronting the needles D of the back needle bed BB hooking the knitted loops of the first wale thereon and also the knitting yarn is temporarily held on the needles A located at both lateral sides of the needles B (2nd step).

Then, the knitting yarn temporarily held on the needles A is released from the needles A, keeping the tuck loops held on the needles B, as shown in FIG. 1(5) (3rd step). As a result of the knitting yarn temporarily held on the needles A being released therefrom in this manner, lengths of the knitting yarn extending from both legs of each tuck loop on the needle B between the needles B and the needles C become equal to each other.

Thus, the knitting yarn temporarily held on the needles A serves as a drop portion or a length adjusting portion for the tuck loop and the knitted loop around. This way of temporarily holding the knitting yarn on the needles and then releasing it therefrom can provide an extended length of the knitted loop and can also provide a well-balanced shape thereof.

Then, the knitted loops of the front knitted fabric part hooked on the back needle bed BB are all transferred to the front needle bed FB, as shown in FIG. 1(6). As a result of this loop transference, the loops are put in the state of FIG. 2(7) wherein the knitted loops of the front knitted fabric part are all hooked by the knitting needles of the front needle bed FB and the knitted loops of the back knitted fabric part are all hooked by the knitting needles of the back needle bed BB. In this process, the knitted loops hooked by the needles D of the back needle bed BB are transferred to the needles B of the front needle bed FB hooking the tuck needles thereon, so that the knitted loops and tuck loops of the first wale are put in the overlapped state.

Then, the back knitted fabric part is knitted one course. The knitted loops hooked by the knitting needles of the back needle bed BB are all transferred to empty needles of the front needle bed FB, as shown in FIG. 2(8), to produce the state of FIG. 2(9) (5th step).

Figure 2:
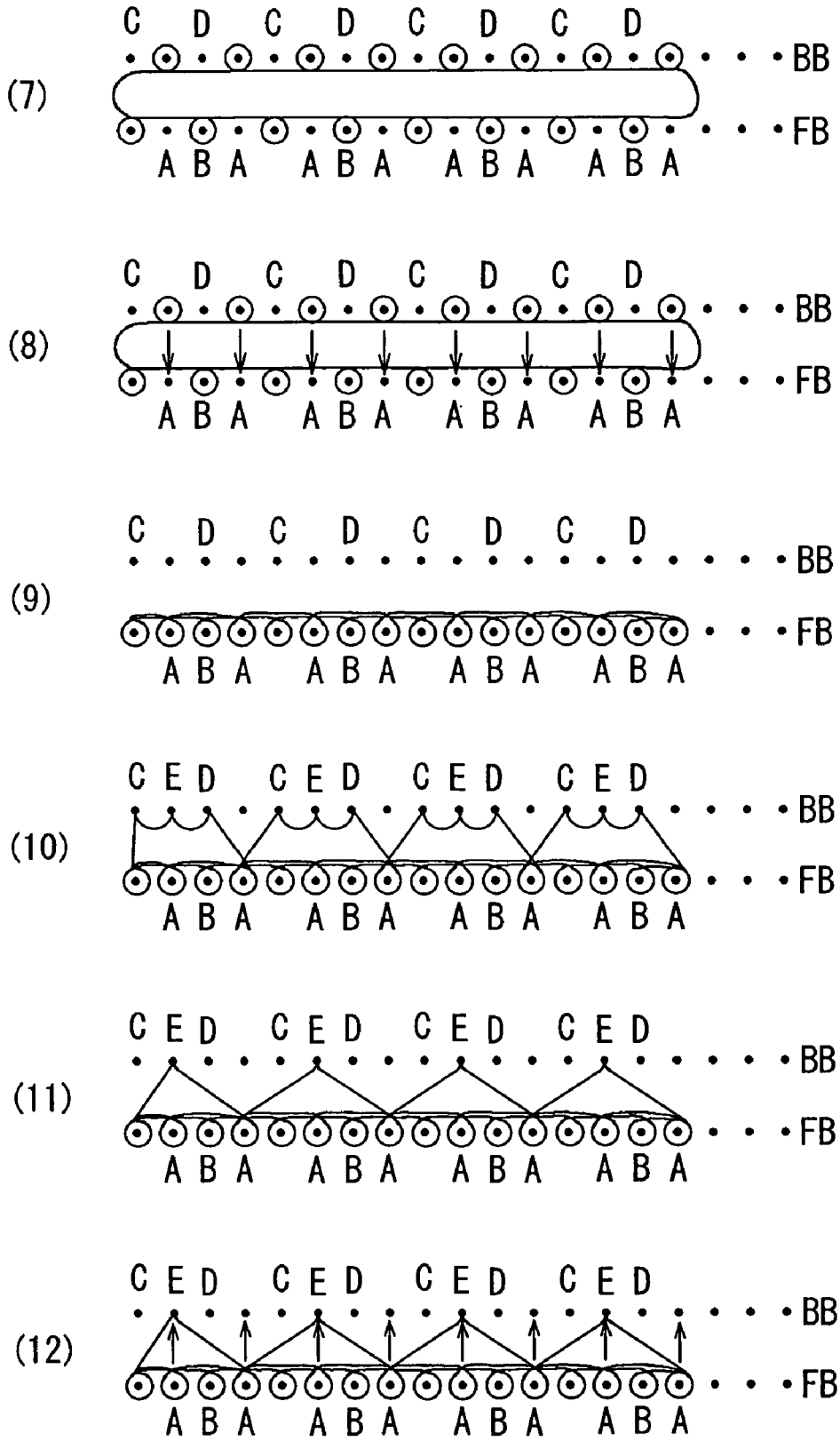
FIG. 2 is a knitting process drawing showing the subsequent processes from the processes of FIG. 1 of the knitting method for knitting the knitted fabric having the half cardigan knitting structure.

Then, among the knitted loops transferred to the empty needles of the front needle bed FB, the knitted loops following the knitted loops of the second wale (the knitted loops hooked by the needles A) are knitted on the front needle bed FB, as shown in FIG. 2(10). In parallel with this, tuck loops are formed on the needles E of the back needle bed BB confronting the needles A of the front needle bed FB hooking the knitted loops of the first wale thereon and also the knitting yarn is temporarily held on the needles C, D located at both lateral sides of the needles E (6th step).

Then, the knitting yarn temporarily held on the needles C, D is released from the needles C, D, keeping the tuck loops held on the needles E, as shown in FIG. 2(11) (7th step). As a result of the knitting yarn temporarily held on the needles C, D being released therefrom in this manner, lengths of the knitting yarn extending from both legs of each tuck loop on the needle E between the needles E and the needles A become equal to each other.

Thus, the knitting yarn temporarily held on the needles C, D serves as the drop portion or the length adjusting portion for the tuck loop and the knitted loop around. This way of temporarily holding the knitting yarn on the needles and then releasing it therefrom can provide an extended length of the knitted loop and can also provide a well-balanced shape thereof.

Then, the knitted loops of the back knitted fabric part hooked on the front needle bed FB are all transferred to the back needle bed BB, as shown in FIG. 2(12). As a result of this loop transference, the loops are put in the state of FIG. 3(13) wherein the knitted loops of the back knitted fabric part are all hooked by the knitting needles of the back needle bed BB and the knitted loops of the front knitted fabric part are all hooked by the knitting needles of the front needle bed FB. In this process, the knitted loops hooked by the needles A of the front needle bed FB are transferred to the needles E of the back needle bed BB hooking the tuck needles thereon, so that the knitted loops and tuck loops of the first wale are put in the overlapped state (8th step).

After the knitting of the back knitted fabric part by one course is completed, the knitting of the front knitted fabric part proceeds. In this knitting process, the knitted loops of the second wale on the front needle bed FB are transferred to the empty needles C of the back needle bed BB and then knitted with the needles C. In parallel with this, the knitted loops of the first wale of the front knitted fabric part are formed with the needles B and also the knitting yarn is temporarily held on the empty needles A at both lateral sides of the needles B, as shown in FIG. 3(14) (9th step).

Figure 3:
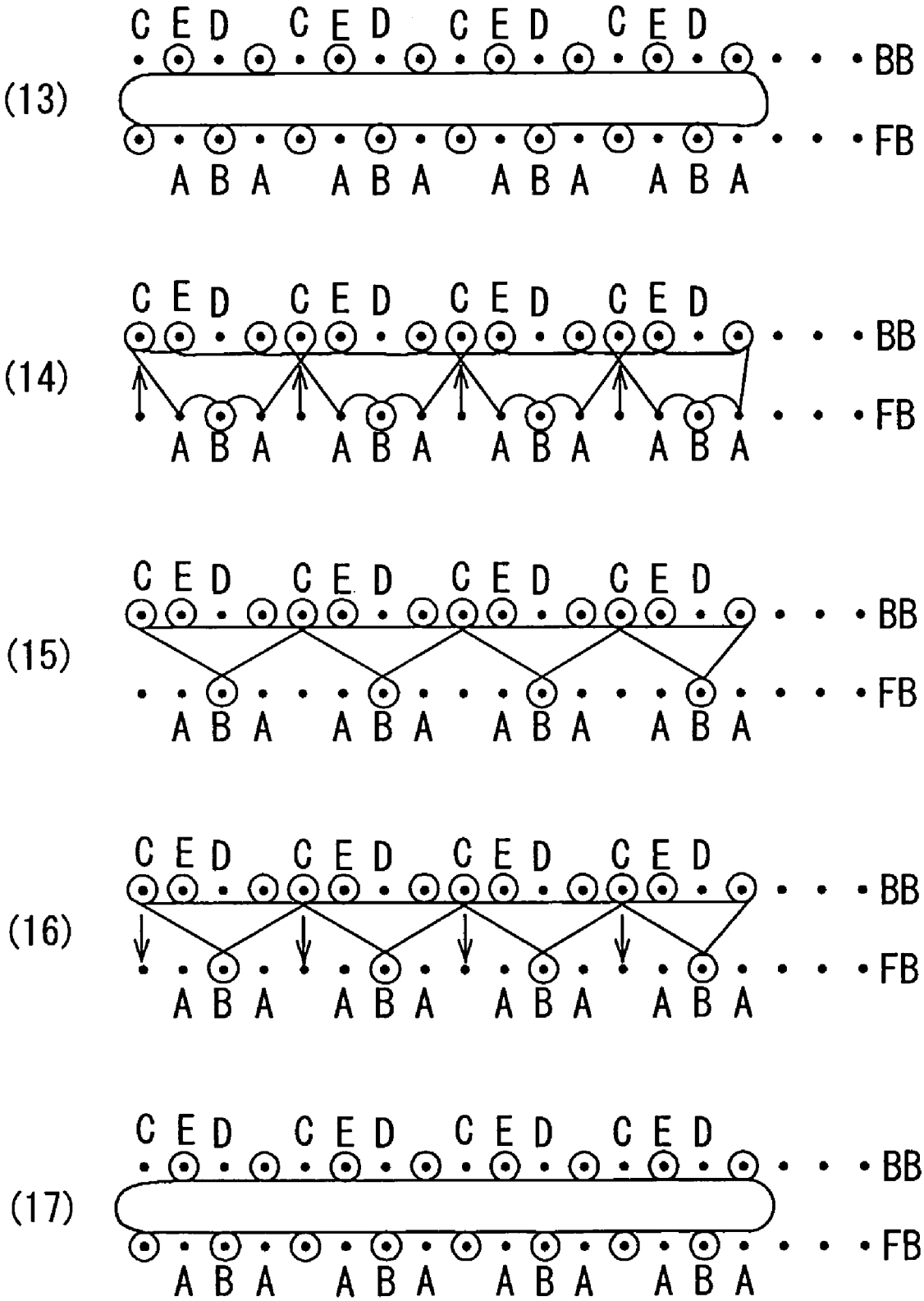
FIG. 3 is a knitting process drawing showing the subsequent processes from the processes of FIG. 2 of the knitting method for knitting the knitted fabric having the half cardigan knitting structure.

Then, after the knitting yarn temporarily held on the empty needles A is released therefrom, as shown in FIG. 3(15) (10th step), the knitted loops hooked by the needles C of the back needle bed BB are transferred to the knitting needles of the front needle bed FB, as shown in FIG. 3(16), to thereby produce the state of FIG. 3(17) (11th step).

Figure 4:
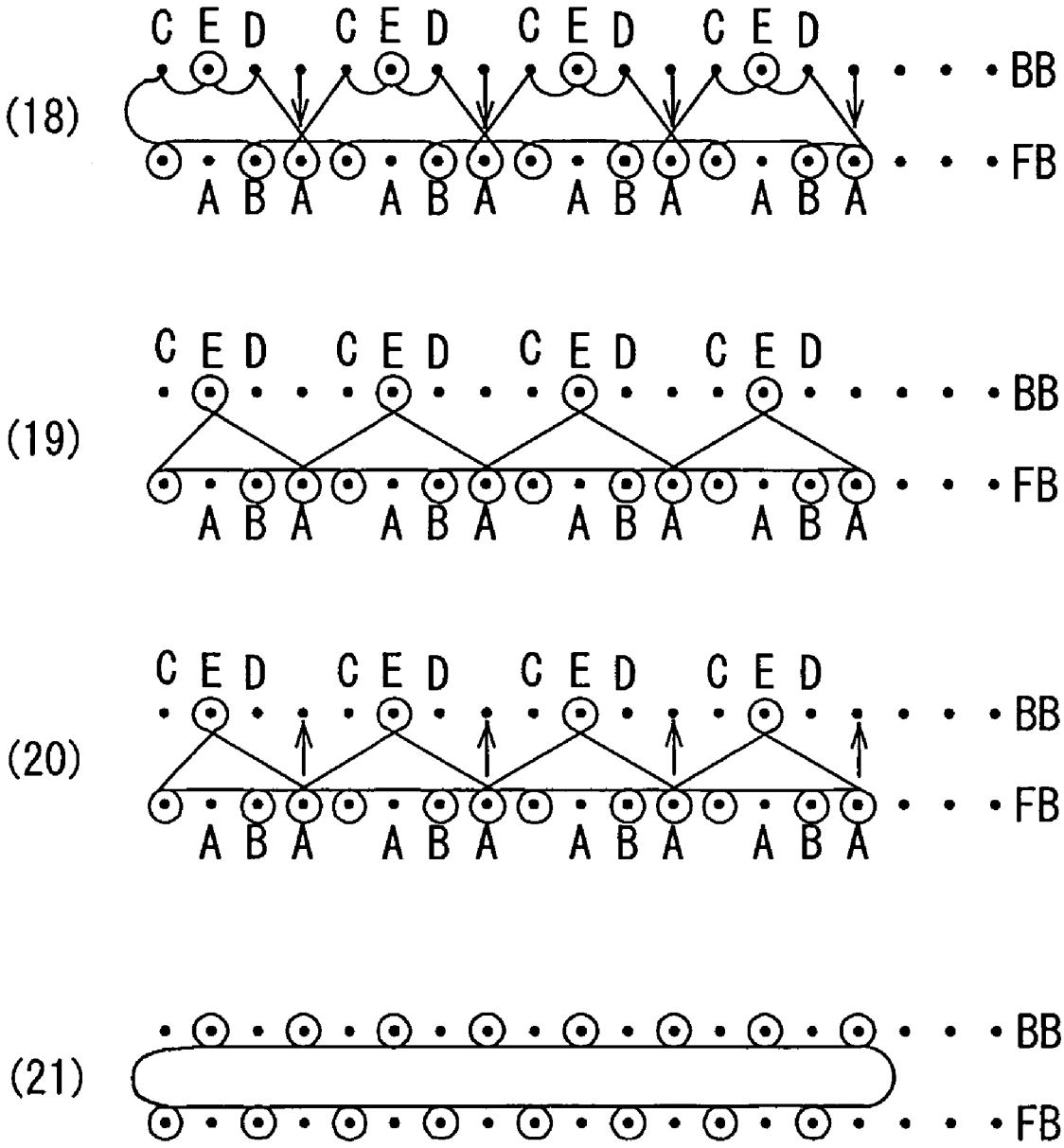
FIG. 4 is a knitting process drawing showing the subsequent processes from the processes of FIG. 3 of the knitting method for knitting the knitted fabric having the half cardigan knitting structure.

Then, the knitting of the back knitted fabric part proceeds. As shown in FIG. 4(18), the knitted loops of the second wale on the back needle bed BB are transferred to the empty needles A of the front needle bed FB and then knitted with those needles A. In parallel with this, the knitted loops of the first wale of the back knitted fabric part are formed with the needles E and also the knitting yarn is temporarily held on the empty needles C, D at both lateral sides of the needles E (12th step).

Then, after the knitting yarn temporarily held on the empty needles C, D is released therefrom, as shown in FIG. 4(19) (13th step), the knitted loops hooked by the needles A of the front needle bed FB are transferred to the knitting needles of the back needle bed BB, as shown in FIG. 4(20), to thereby produce the state of FIG. 4(21) (14th step).

Figure 5:
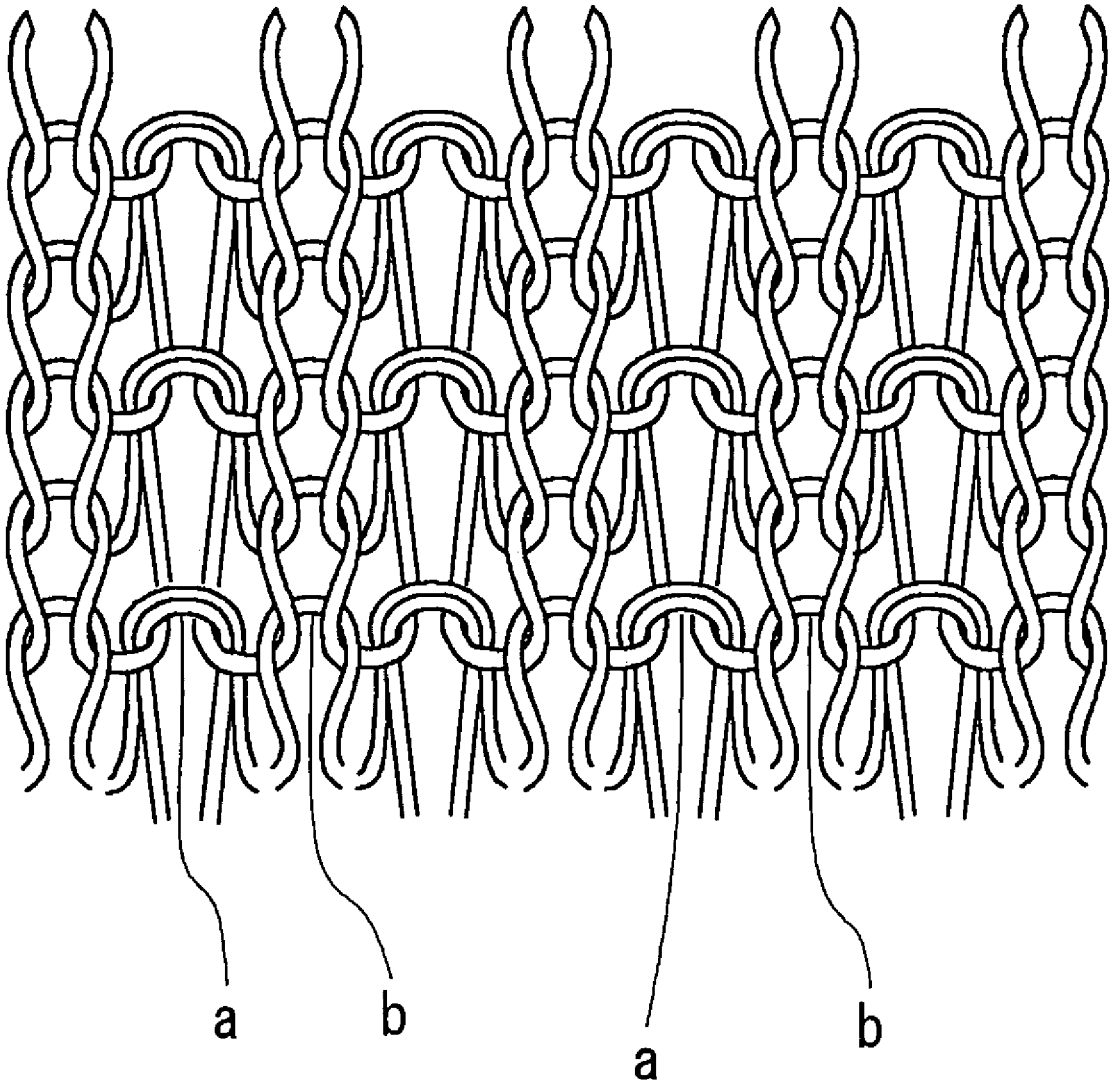
FIG. 5 is a partial plan view of the half cardigan knitting structure.
Figure 6:
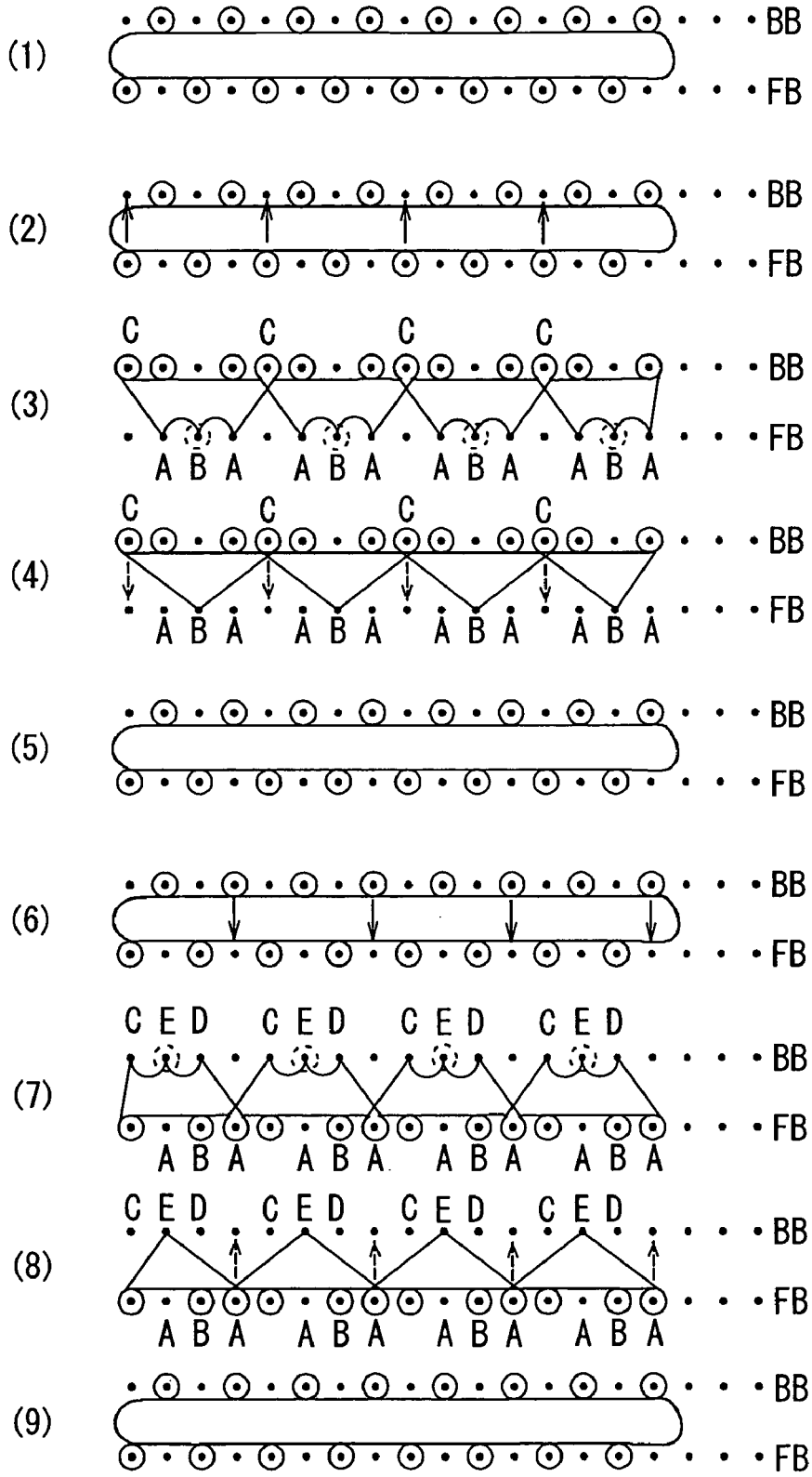
FIG. 6 is a knitting process drawing of a conventional knitting method for knitting a knitted fabric having a half cardigan knitting structure.
Figure 7:
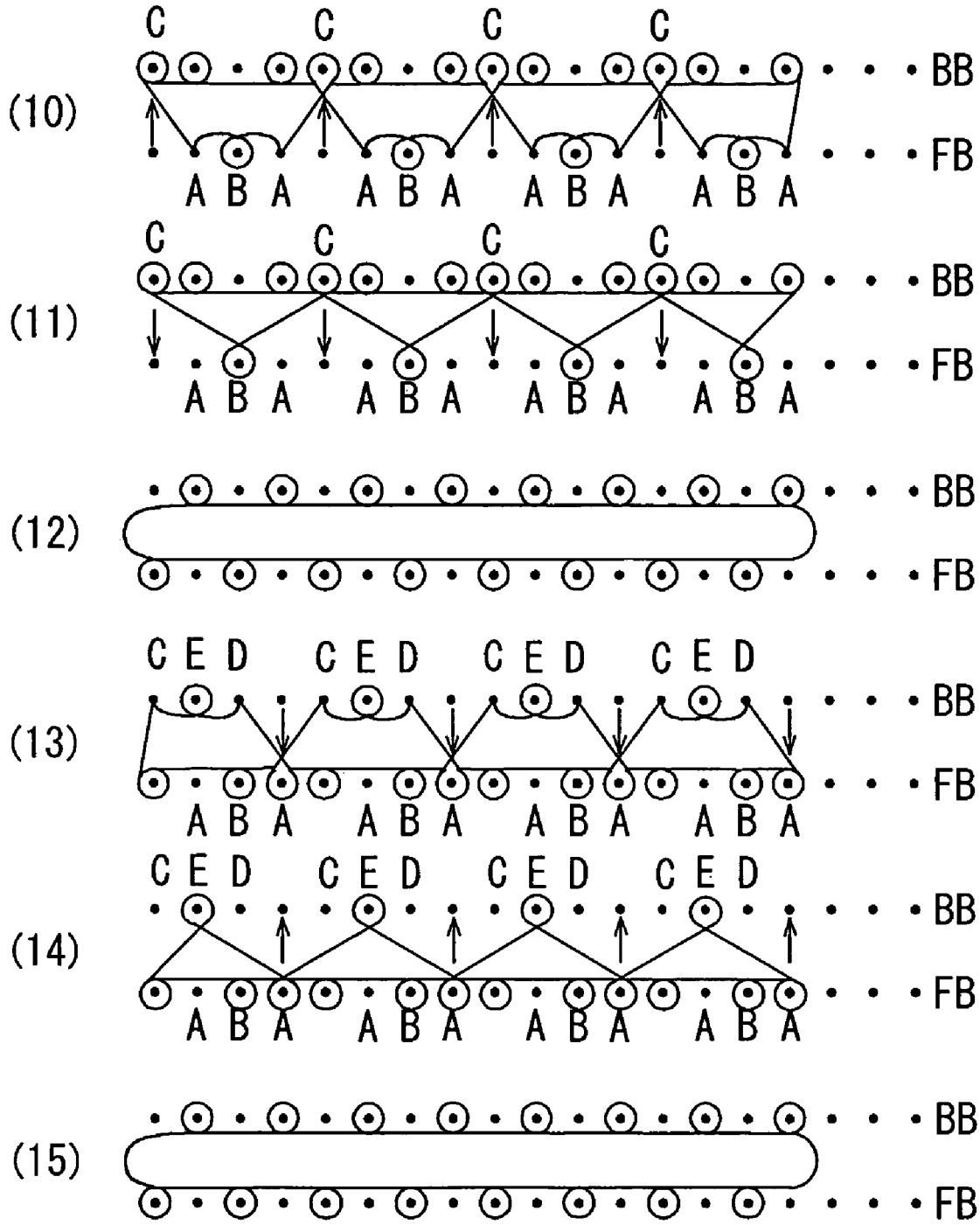
FIG. 7 is a knitting process drawing showing the subsequent processes from the processes of FIG. 6 of the conventional knitting method for knitting the knitted fabric having the half cardigan knitting structure.

By repetition of the knitting steps illustrated in FIG. 1(1) through FIG. 4(21), a tubular knitted fabric of coarse knitting gauge having the half cardigan knitting structure shown in FIG. 5 can be knitted. In the knitting process mentioned above, the knitting yarn temporarily held on the empty needles serve as the drop portion or the length adjusting portion for the knitted loops and the tuck loops to be increased in size.

In the knitting technique of the illustrated embodiment, since the knitwear is knitted in a tubular form in seamless manner, the back side of the half cardigan knitting structure can be taken as the front side of the knitwear, and vice versa.

According to this embodiment, the first wale and the second wale are formed using the alternate needles, while also the temporal holding of the knitting yarn is performed, as described above. This can allow the knitted fabric having the half cardigan knitting structure to be knitted with coarse loops. This can permit the use of a thicker knitting yarn to the extent to which the loops are roughened, and as such can provide texture differences for the knitted fabric of the half cardigan knitting structure.

Also, according to this embodiment, the knitted loops of the first wale are transferred to the empty needles confronting the back needle bed BB in advance of the formation of the tuck loops so that the tuck loops can be formed with the empty needles B. This can provide the result that the tuck loops can be prevented from contacting with the knitted loops, differently from the conventional first wale, as mentioned above. This can produce the result that when the knitting yarn temporarily held for the dropping is released, the tuck loops can slip so smoothly in the needles B that the knitting yarn dropped can be absorbed in the loops around in a well-balanced manner.

Also, since the tuck loops and the knitted loops in the first wale are not overlapped with each other before the tuck loops are formed with the well-balanced knitting yarn, as mentioned above, the loops of the first wale and the loops of the second wale can be formed uniformly in the entirety of the knitted fabric. Besides, since the lengths of the knitting yarn dropped can fully be absorbed in the knitted loops and the tuck loops, the knitted fabric having large loops or coarse loops can be knitted.

Although the embodiment wherein the knitting yarn is temporarily held on the needles at both lateral sides of the needle on which the tuck loop is formed has been illustrated above, the knitting yarn may be temporarily held on only the empty needle at either side of the needle in accordance with lengths of the knitting yarn dropped (loop lengths of the knitted loops and tuck loops). The loop lengths of the loops can be adjusted by adjusting the lengths of the knitting yarn dropped. Although the embodiment wherein the front knitted fabric part and the back knitted fabric part are all knitted with the half cardigan knitting structure has been described above, it is needless to say that the present invention is applicable to the knitting that the half cardigan knitting structure is knitted in a part of the knitted fabric. Additionally, a non-tubular knitted fabric (a single layer) can also be knitted with the empty needles on either the front needle bed or the back needle bed.

INDUSTRIAL APPLICABILITY

As mentioned above, the present invention can provide the result that even when the knitted fabric of the half cardigan knitting structure is knitted in such a manner as to have the first wale and the second wale alternately while the knitting yarn being temporarily held on the needles, the knitted loops and tuck loops can be formed in well-balanced shape, thus providing a beautiful knitted fabric as a whole. It can also permit facilitation of the loop transfer and the knitting, thus providing well-balanced loops even when the tuck loops are wanted to be increased in stitch density.

The invention claimed is:

1. A knitting method for knitting a knitted fabric having a half cardigan knitting structure wherein first wale in which knitted loops and tuck loops are formed and second wale in which only the knitted loops are formed are alternately formed with alternate needles of a flat knitting machine comprising at least a pair of front and back needle beds (FB, BB) which are arranged to extend laterally and opposite to each other in a cross direction and between which loops of the knitted fabric are transferred, the method comprising:

1) the first step of supplying the knitted loops of the first wale to one of the needle beds (FB) and supplying the knitted loops of the second wale to the other needle bed (BB) and then transferring the knitted loops of the first wale to confronting empty needles of the other needle bed (BB), 2) the second step of forming the knitted loops of the second wale on the other needle bed (BB), while forming the tuck loops on the needles of the one needle bed (FB) which confront the needles of the other needle bed (BB) hooking the knitted loops of the first wale and also holding the knitting yarn temporarily on at least one of adjoining needles to the needle forming the tuck loop thereon, 3) the third step of releasing the knitting yarn temporarily held on the needles therefrom, 4) the fourth step of transferring the knitted loops of the first wale hooked by the needles of the other needle bed (BB) to the needles of the one needle bed (FB) hooking the tuck loops, 5) the fifth step of forming the loops, following the tuck loops and knitted loops of the first wale hooked by the needles of the one needle bed (FB), and also holding the knitting yarn temporarily on at least one of the adjoining needles to the needle used to form the first wale and then forming the loops of the second wale on the needles of the other needle bed (BB), and 6) the sixth step of releasing the knitting yarn temporarily held on the needles therefrom.

2. The knitting method according to claim 1, wherein after completion of the sixth step of claim 1, the steps 1–6 of claim 1 are repeated.

3. The knitting method according to claim 1 for knitting a tubular knitted fabric having a front knitted fabric part and a back knitted fabric part and having the half cardigan knitting structure in at least one of the front knitted fabric part and the back knitted fabric part, the knitting method comprises:

the first step wherein the knitted loops of the first wale and the second wale of at least either the front knitted fabric part or the back knitted fabric part, at least either of which has the half cardigan knitting structure, are all transferred to empty needles of the opposite needle bed, and the fifth step wherein the knitted loops of the second wale of at least either the front knitted fabric part or the back knitted fabric part, at least either of which has the half cardigan knitting structure, are all transferred to the empty needles of the opposite needle bed and knitted with knitting needles of the opposite needle bed, and, then, the loops are formed, following the tuck loops and the knitted loops of the first wale, while also the knitting yarn is temporarily held on at least one of adjoining needles to the needle used to form the first wale.

4. The knitting method according to claim 3, which further comprises:

1) the first step of transferring all the knitted loops of the first wale and the second wale to confronting empty needles of the other needle bed (BB) in the state in which the knitted loops of the first wale and the knitted loops of the second wale of the front knitted fabric part are supplied to one needle bed (FB) and the knitted loops of the first wale and the knitted loops of the second wale of the back knitted fabric part are supplied to the other needle bed (BB), 2) the second step for the front knitted fabric part of forming the knitted loops of the second wale on the other needle bed (BB), while also forming the tuck loops on the needles of the one needle bed (FB) which confront the needles of the other needle bed (BB) hooking the knitted loops of the first wale and also holding the knitting yarn temporarily on at least one of adjoining needles to the needle forming the tuck loop thereon, 3) the third step for the front knitted fabric part of releasing the knitting yarn temporarily held on the needles of the one needle bed (FB) therefrom, 4) the fourth step for the front knitted fabric part of transferring the knitted loops of the first wale hooked by the needles of the other needle bed (BB) to the needles of the one needle bed (FB) hooking the tuck loops, and transferring the knitted loops of the second wale to confronting needles of the one needle bed (FB), 5) the fifth step for the back knitted fabric part of transferring all the knitted loops of the first wale and the second wale to confronting empty needles of the one needle bed (FB), 6) the sixth step for the back knitted fabric part of forming the loops of the second wale on the one needle bed (FB) and forming the tuck loops on the needles of the other needle bed (BB) confronting the needles of the one needle bed (FB) hooking the knitted loops of the first wale, while also holding the knitting yarn temporarily on at least one of the adjoining needles to the needle used to form the tuck loops, 7) the seventh step for the back knitted fabric part of releasing the knitting yarn temporarily held on the needles of the other needle bed (BB) therefrom, 8) the eighth step for the back knitted fabric part of transferring the knitted loops of the first wale hooked by the needles of the one needle bed (FB) to the needles of the other needle bed (BB) hooking the tuck loops and transferring the knitted loops of the second wale to the confronting needles of the other needle bed (BB), 9) the ninth step for the front knitted fabric part of transferring the knitted loops of the second wale to the confronting empty needles of the other needle bed (BB) and then knitting those loops of the second wale with the needles of the other needle bed (BB), while also forming the loops following the tuck loops and knitted loops of the first wale hooked by the needles of the one needle bed (FB) and holding the knitting yarn temporarily on at least one of the adjoining needles to the needle used to form the first wale, 10) the tenth step for the front knitted fabric part of releasing the knitting yarn temporarily held on the needles of the one needle bed (FB) therefrom, 11) the eleventh step for the front knitted fabric part of transferring the knitted loops of the second wale to the confronting needles of the one needle bed (FB), 12) the twelfth step for the back knitted fabric part of transferring the knitted loops of the second wale to the confronting empty needles of the one needle bed (FB) and then knitting those loops of the second wale with the needles of the one needle bed (FB), while also forming the loops following the tuck loops and knitted loops of the first wale hooked by the needles of the other needle bed (BB) and holding the knitting yarn temporarily on at least one of the adjoining needles to the needle used to form the first wale, 13) the thirteenth step for the back knitted fabric part of releasing the knitting yarn temporarily held on the needles of the other needle bed (BB) therefrom, and 14) the fourteenth step for the back knitted fabric part of transferring the knitted loops of the second wale to the confronting needles of the other needle bed (BB).

5. The knitting method according to claim 4, wherein after completion of the fourteenth step of claim 4, the steps 1–14 of claim 4 are repeated.

* * * * *